US008121313B2

(12) United States Patent
Cantelobre

(10) Patent No.: US 8,121,313 B2
(45) Date of Patent: Feb. 21, 2012

(54) MICROPHONE MADE FROM A POLYMER WAVEGUIDE

(75) Inventor: Michel Cantelobre, Los Gatos, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 957 days.

(21) Appl. No.: 12/118,575

(22) Filed: May 9, 2008

(65) Prior Publication Data

US 2008/0279397 A1 Nov. 13, 2008

Related U.S. Application Data

(60) Provisional application No. 60/917,607, filed on May 11, 2007.

(51) Int. Cl.
*H04R 3/00* (2006.01)

(52) U.S. Cl. ..... 381/113; 381/112

(58) Field of Classification Search ..... 381/112, 381/113

See application file for complete search history.

(56) References Cited

U.S. PATENT DOCUMENTS

| | | | | |
|---|---|---|---|---|
| 4,678,905 | A * | 7/1987 | Phillips | 250/227.21 |
| 5,891,747 | A * | 4/1999 | Farah | 438/31 |
| 7,293,463 | B2 * | 11/2007 | Suzuki et al. | 73/655 |
| 7,444,877 | B2 * | 11/2008 | Li et al. | 73/651 |
| 2005/0052724 | A1 * | 3/2005 | Suzuki et al. | 359/305 |

* cited by examiner

*Primary Examiner* — Luan C Thai

(74) *Attorney, Agent, or Firm* — Beyer Law Group LLP

(57) ABSTRACT

An apparatus and method for making a microphone that is not susceptible to RF noise and that can be fabricated to be very thin. The microphone includes a light transmitter configured to generate light, a waveguide having optically aligned transmit, vibrating and receive sections, and a receiver. Light from the transmitter is configured to be transmitted through the transmit section, vibrating section and the receive section of the waveguide, and to the receiver. The vibrating section of the waveguide is configured to vibrate in response to received acoustic energy, so that the light received by the receive section is modulated in proportion to the acoustic energy. In response, the receiver converts the modulated light to an electrical signal that is indicative of the received acoustic energy. Since the microphone of the present invention uses a thin waveguide to modulate the acoustic energy, it is not susceptible to RF noise, and it can be made to have a very thin profile.

18 Claims, 4 Drawing Sheets

MICROPHONE MADE FROM A POLYMER WAVEGUIDE

CROSS REFERENCE TO RELATED APPLICATIONS

This application claims priority of provisional application No. 60/917,607 which is incorporated herein by reference.

BACKGROUND

1. Field of the Invention

The present invention relates to a microphone, and more particularly, to a microphone that includes a polymer waveguide that modulates a light signal to be proportional to receive acoustic energy and a receiver that converts the modulated light signal into a corresponding electrical signal that is indicative of the received acoustic energy.

2. Background of the Invention

Microphones are commonly used in a wide variety of applications, for example in the transmitters of land-line telephones and cell phones, in the broadcast, recording and entertainment industries, in auditoriums or conference rooms, and other locations where persons make public appearances or speeches. A typical microphone includes a membrane that is mounted adjacent a cavity in an acoustic housing. A capacitor and an amplifier circuit are coupled to the membrane within the housing. When acoustic energy is received through the cavity, it causes the membrane to vibrate. As the membrane vibrates, the charge on the capacitor is proportionally altered. The amplifier amplifies the varying charge, generating a corresponding electrical signal that is indicative of the received acoustic energy.

There are a number of problems associated with known microphones, such as that described above. They tend to be sensitive to radio frequency (RF) noise. This is particularly problematic with cell phones for example, where RF signals are being transmitted and received. There is also no way to filter or otherwise reduce the amplification of ambient noise. The thickness of the acoustic housing can also be a problem in certain applications. Again, using cell phones as an example, manufacturers are continually striving to provide consumers with smaller and thinner cell phones. The thickness of the acoustic housing used for the microphone may therefore be a limiting factor in how thin cell phones can be made.

A microphone that is not susceptible to RF noise and that can be fabricated to be very thin is therefore needed.

SUMMARY OF THE INVENTION

An apparatus and method for making a microphone that is not susceptible to RF noise and that can be fabricated to be very thin is disclosed. The microphone includes a light transmitter configured to generate light, a waveguide having optically aligned transmit, vibrating and receive sections, and a receiver. Light from the transmitter is configured to be transmitted through the transmit section, vibrating section and the receive section of the waveguide, and to the receiver. The vibrating section of the waveguide is configured to vibrate in response to received acoustic energy, so that the light received by the receive section is modulated in proportion to the acoustic energy. In response, the receiver converts the modulated light to an electrical signal that is indicative of the received acoustic energy. Since the microphone of the present invention uses a thin waveguide to modulate the acoustic energy, it is not susceptible to RF noise, and it can be made to have a very thin profile.

BRIEF DESCRIPTION OF THE DRAWINGS

Like elements are designated by like reference numbers in the Figures.

DETAILED DESCRIPTION OF THE PREFERRED EMBODIMENTS

Figure 1:
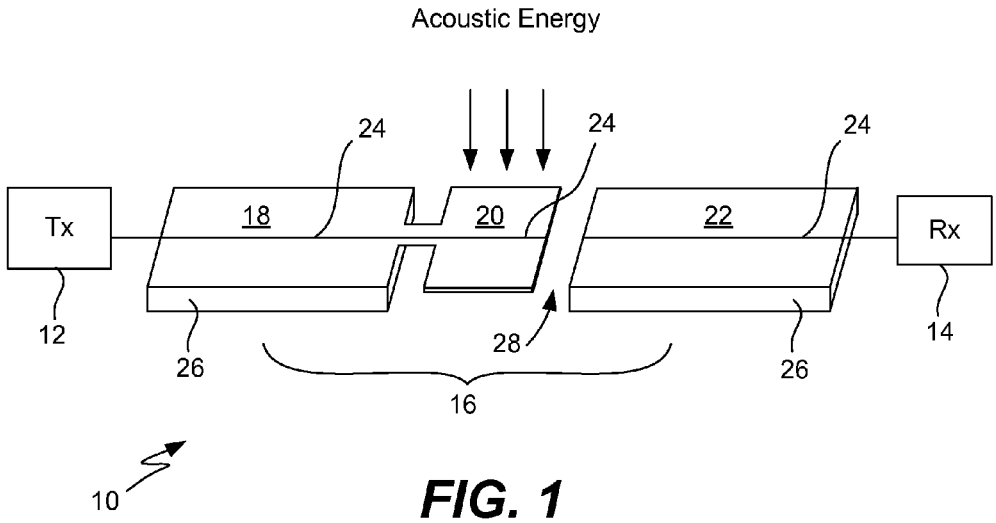
FIG. 1 is a perspective view of a polymer waveguide microphone according to the present invention.

Referring to FIG. 1, a perspective view of a polymer waveguide microphone according to the present invention is shown. The microphone 10 includes a light transmitter 12, a receiver 14 and a waveguide 16 positioned between the transmitter 12 and the receiver 14. The waveguide 16 includes three sections, including a transmit section 18, a vibrating section 20 and a receive section 22. A waveguide groove 24, filled with an optically transparent material, traverses the three sections. The groove 24 on the three sections 18, 20 and 22, the transmitter 12 and the receiver 14 are all optically aligned with one another.

The transmit section 18 and the receive section 22 are each mounted on a substrate 26. The vibrating section 20, however, is positioned in the free space between the transmit section 18 and the receive section 22. This arrangement allows the vibrating section 20 to freely vibrate in response to receive acoustic energy (as represented by the arrows. As evident in the figure, the waveguide groove 24 on the transit section 18 and the vibrating section 20 is continuous. A gap 28, however, is provided between the groove 24 on the vibrating section 20 and the receive section 22.

During operation, the transmitter 12 generates light, which is conducted down the groove 24 of the transit section 18 and the vibrating section 20. In response to the acoustic energy, the vibrating section 20 vibrates. The waveguide groove 24 on the receive section 22, which is optically coupled with the groove 24 on the vibrating section, receives light which is in proportion to the acoustic energy received at the vibrating section 20.

Figure 2:
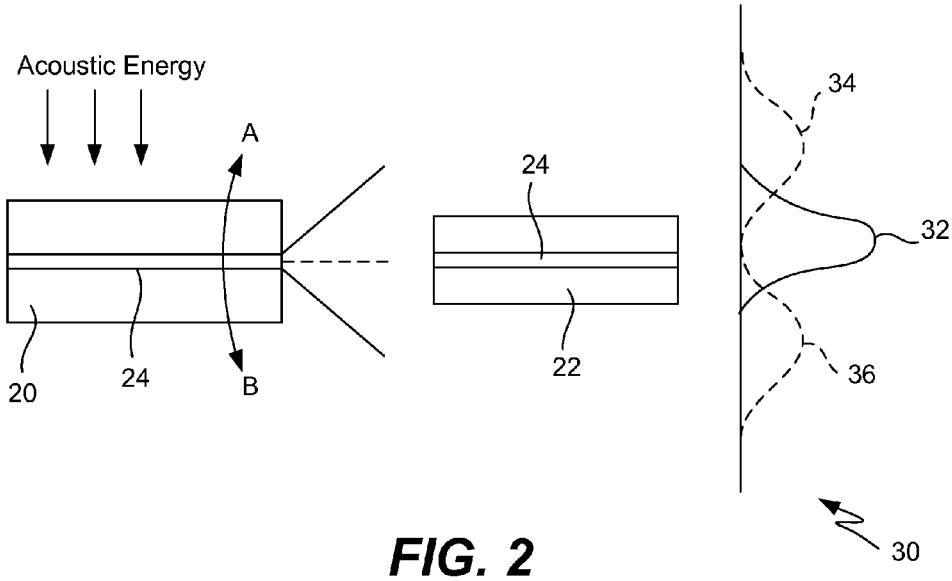
FIG. 2 is a diagram illustrating light distribution curves of the waveguide in response to received acoustic energy in accordance with the present invention.

Referring to FIG. 2, a diagram illustrating the spatial light distribution of the polymer waveguide in response to received acoustic energy is shown. When no acoustic energy is received, the section 20 does not vibrate. As a result, the received light at the waveguide groove 24 on the receive section 22 is maximized. In response to acoustic energy, however, the vibration section 20 vibrates, moving up and down as designated by the positions A and B, relative to the receive section 22. As a result of these vibrations, the amount or degree of optical coupling between the waveguide groove 24 on the vibration section 20 and the receive section 22 is reduced.

The spatial distribution waveform 30 shows the distribution of received light, depending on the position of the vibrating section 20. When there is no acoustic energy input and the vibrating section 20 is stationary, the amount of received light has the largest magnitude, as designated by the light intensity distribution curve 32. On the other hand, when the section 20 is vibrating between positions A and B for example, the amount of received light is decreased, as designated by the light intensity distribution curves 34 and 36 respectively. Thus, as the vibrating section 20 vibrates in response to the received acoustic energy, the light received by the receive section 22 is proportionally modulated.

Figure 3:
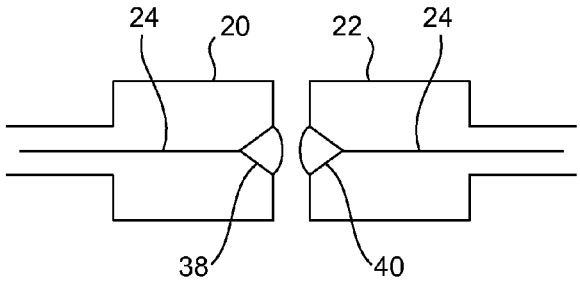
FIG. 3 is a polymer waveguide with lenses used in the microphone according to another embodiment of the present invention.

Referring to FIG. 3, a polymer waveguide used as a microphone according to another embodiment is shown. In this embodiment, lenses 38 and 40 are provided at the terminal ends of the waveguide groove 24 on both the vibrating section 20 and the receive section 22. The lenses 38 and 40 tend to increase the optical coupling between the two sections of the waveguide groove 24.

Figure 4:
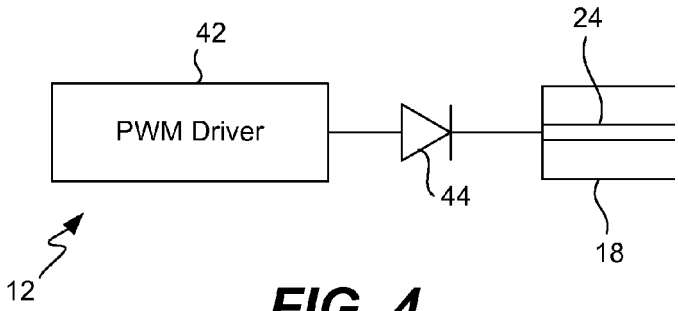
FIG. 4 is a light transmitter used with the polymer waveguide microphone according to the present invention.

Referring to FIG. 4, a diagram of the light transmitter 12 according to one embodiment is shown. The light transmitter 12 includes a Pulse Width Modulation (PWM) driver 42 and a Light Emitting Diode (LED) 44. The output of the LED 44 is optically coupled to the input of the waveguide groove 24 of the transmit section 18. During operation, the PWM driver 42 controls the delivery of power to the LED. In response, the LED 44 generates light, which is optically coupled to the waveguide groove 24 of the transmit section 18. In an alternative embodiment, a Vertical Cavity Surface Emitting Laser (VCSEL) may be used in place of the LED.

Figure 5:
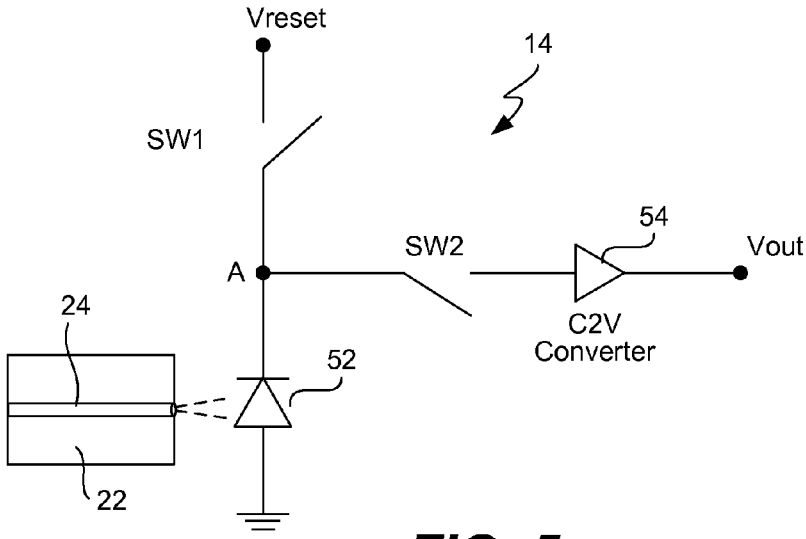
FIG. 5 is a light receiver circuit used with the polymer waveguide microphone according to the present invention.

Referring to FIG. 5, a circuit diagram of the receiver 14 according to one embodiment of the invention is shown. The receiver 14 includes a first switch SW1, a photo diode 52, a second switch SW2, and a charge-to-voltage converter 54. The switch SW1 is coupled between voltage Vreset and the cathode of the photodiode 52 at node A. The anode of the photodiode 52 is connected to ground. The switch SW2 is connected between node A and the input of the charge-to-voltage converter 54. The photodiode 52 is positioned adjacent to and is configured to receive the light exiting the waveguide groove 24 of the receive section 22 of the waveguide 16.

The photodiode 52, which acts as a capacitor in this circuit configuration, tends to leak current from ground to Vreset when exposed to light. The amount of current leakage is proportional to the intensity of the light from the waveguide groove 24 of the receive section 22. In other words, the greater the intensity of light, the more current leakage and the smaller the capacitance. Alternatively, when the intensity of the received light is small, there is less current leakage, and more capacitive charge is stored on the photodiode 52. The capacitive charge is therefore inversely proportional to the intensity of light received by the receive section 22 from the vibration section 20 of the waveguide 16.

During operation of the receiver 14, the switch SW1 is initially closed, causing node A and the cathode of the photodiode 52 to charge up to Vreset. In response to received light, the diode 52 leaks current. As discussed above, the charge at node A is therefore inversely proportional to the intensity of the light from the waveguide groove 24 of the receive section 22. Switch SW2 is opened and closed at a predetermined sampling rate. Each time the switch SW2 is closed, the capacitance at node A is provided to the input of the charge-to-voltage converter 54. A voltage signal that is indicative of the acoustic energy received by the microphone 10 is therefore generated at the node Vout. In various embodiments, the sampling rate may be 8 Khz or less, between 8 to 16 Khz, between 16 to 44 Khz, or more than 44 Khz.

Figure 6:
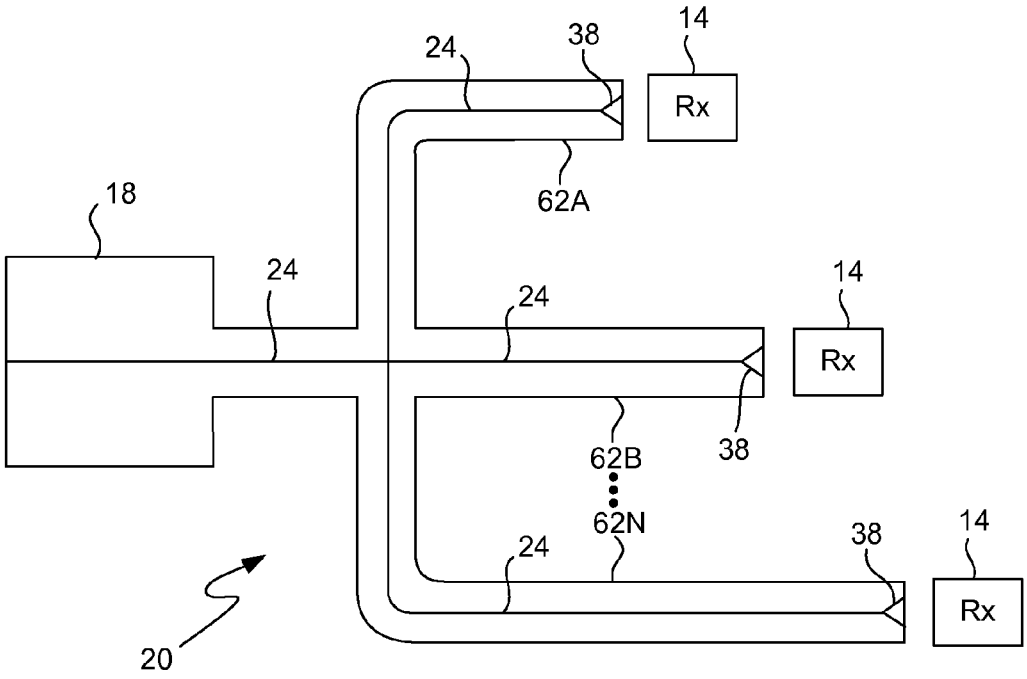
FIG. 6 is a polymer waveguide used in a microphone having an extended dynamic range in accordance with one embodiment of the present invention.

Referring to FIG. 6, a polymer waveguide having an extended dynamic range according to another embodiment of the present invention is shown. In this embodiment, the vibrating section 20 of the waveguide actually includes a plurality of vibrating sections 62A-62N, each capable of independently vibrating with respect to one another. Each of the vibrating sections 62 includes a waveguide groove 24 in optical alignment with the same on the transmit section 18. In the embodiment shown, the vibrating sections 62 are each a different length and have a different stiffness. For example, the vibrating section 62A is shorter in length and stiffer, compared to the vibrating section 62N, which is longer and more flimsy. The various lengths of the vibrating sections 62 each have a different sensitivity to acoustic energy. The dynamic range of the microphone 10 can therefore be extended. For example, by using shorter and stiffer vibrating sections 62, the sensitivity can be decreased. With longer less-stiff sections such as 62N, the sensitivity is increased, which vibrates more in response to the same amount of acoustic energy. A plurality of receivers 14 is provided with each vibrating section 62A-62N respectively.

Figure 7:
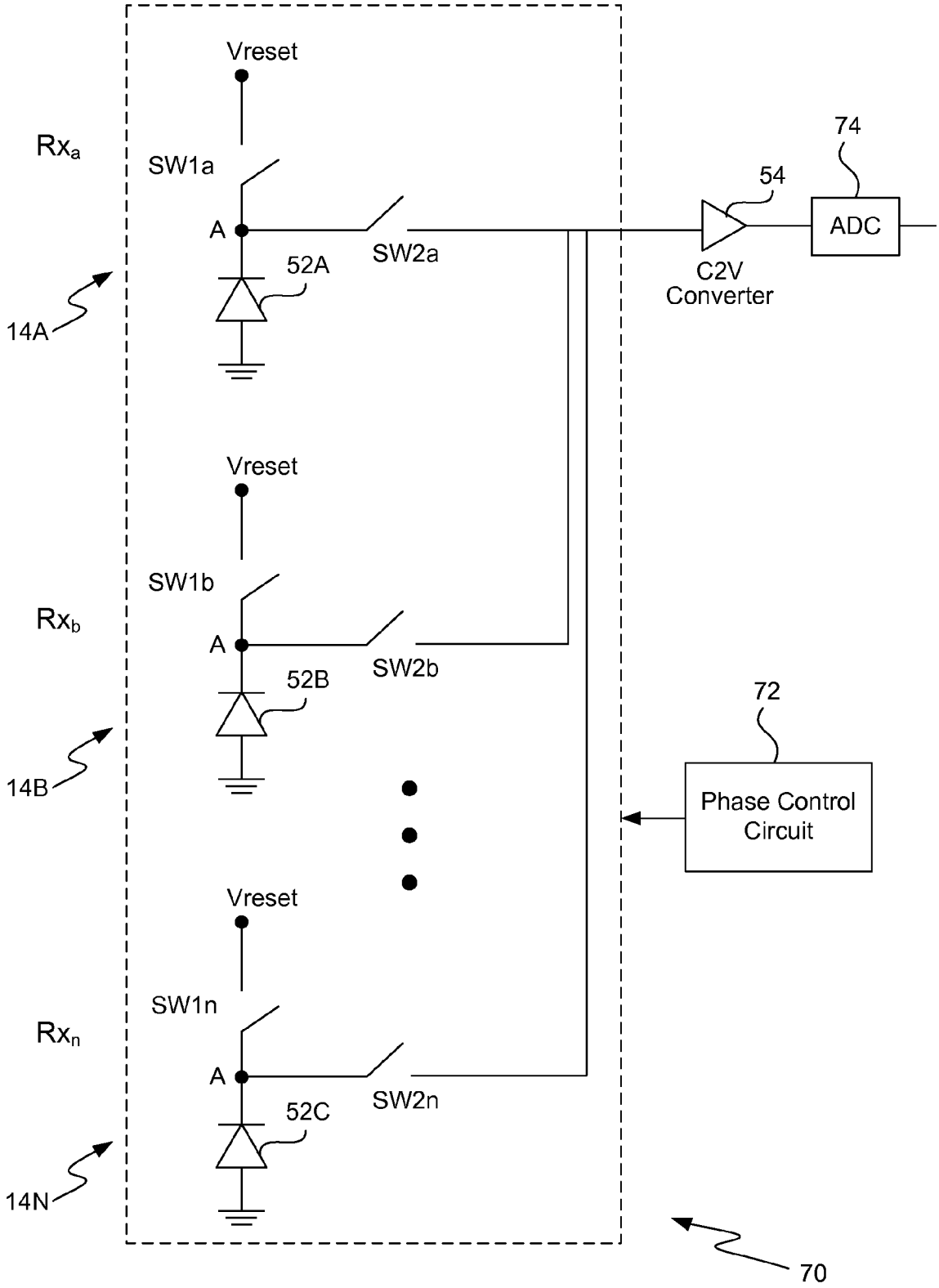
FIG. 7 is a multi-phase light receiver circuit used with the polymer waveguide microphone according to another embodiment of the present invention

Referring to FIG. 7, a multi-phase light receiver circuit 70 used with a polymer waveguide having a plurality of vibrating elements, such as illustrated in FIG. 6 above, is shown. In this embodiment, receiver circuits 14A-14N are each coupled to the input of a charge-to-voltage converter 54. Each of the receiver circuits 14A-14N, which each include switches SW1*a-n* and SW2*a-n*, and photodiodes 52A-N respectively, are essentially the same as described above, and therefore are not described in detail herein. A phase control circuit 72 is coupled the switches SW1*a-n* and SW2*a-n* of each of the receiver circuits 14A-14N respectively. The phase control circuit 72 sequentially the switches SW1*a-n* and SW2*a-n* of each circuit 14A-14N out of phase with respect to one another. As a result, the charge of only one photodiode 52A-52N of a selected circuit 14 is connected to the input of the charge-to-voltage converter 54 at a time. In this manner, a single charge-to-voltage converter 54 and analog-to-digital converter (ADC) 74 can be shared among multiple receiver circuits 14A-14N. In one embodiment, each receiver circuit 14A-14N is equally out of phase. For example, if there is N circuits 14, then they would be N/360 degrees out of phase with respect to one another.

Polymer waveguides 16 can be made in a number of known methods. See for example U.S. patent application Ser. Nos. 11/498,356, 10/861,251, 10/923,550, 10/923,274, 10/923,567, 10/862,003, 10/862,007, 10/758,759 and 10/816,639, all incorporated herein by reference for all purposes.

Figure 8:
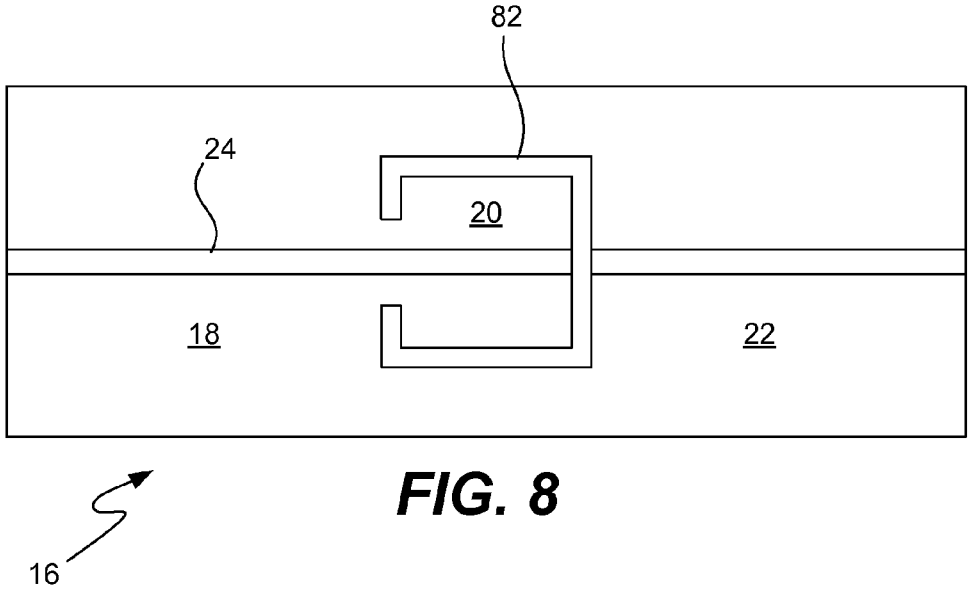
FIG. 8 illustrates a method of making a polymer waveguide in accordance with the present invention.

Referring to FIG. 8, a diagram which illustrates a method of making a polymer waveguide 16 with transmit section 18, vibrating section 20 and a receive section 22 is shown. In the Figure, a waveguide 16 is shown, including the waveguide groove 24, fabricated in a manner described in one of the above applications incorporated by reference. To form the sections 18, 20 and 22, the waveguide 16 is cut along the pattern defined by element 82. In various embodiments, the waveguide 16 may be cut using a laser, stamped using a stamping tool that removes the polymer material in the shape of element 82, or patterned using conventional semiconductor photolithography techniques. Regardless of how the waveguide is cut, the resulting structure includes the three sections 18, 20 and 22 as illustrated in FIG. 1 for example.

While this invention has been described in terms of several preferred embodiments, there are alteration, permutations, and equivalents, which fall within the scope of this invention. It should also be noted that there are many alternative ways of implementing the methods and apparatuses of the present invention. For example, the steps of the present invention may be used to form a plurality of high value inductors 10 across many die on a semiconductor wafer. It is therefore intended that the following appended claims be interpreted as including all such alterations, permutations and equivalents as fall within the true spirit and scope of the present invention.

What is claimed is:

1. A microphone, comprising:

a light transmitter configured to generate light;

a waveguide having optically aligned transmit, vibrating and receive sections, the waveguide configured to transmit the light from the light transmitter and through the transmit, vibrating and receive sections respectively in a substantially linear optical path, wherein the vibrating section is separated from the receive section by a free space by configured to vibrate in response to received acoustic energy so that the light received by the receive section is modulated in proportion to the acoustic energy, wherein said vibration is in a direction substantially transverse to the optical path; and a receiver to convert the modulated light received at the receive section of the waveguide to an electrical signal that is indicative of the received acoustic energy.

2. The microphone of claim 1, wherein the waveguide is a polymer waveguide.

3. The microphone of claim 1, wherein the transmit section and the receive section are provided on a substrate.

4. The microphone of claim 3, wherein the vibrating section is positioned in free space between the transmit section and the receive section of the waveguide.

5. The microphone of claim 4, wherein the vibrating section is attached to the transmit section of the waveguide.

6. The microphone of claim 1, further comprising a plurality of vibrating sections and a plurality of receive sections, both the plurality of vibrating sections and the plurality of receive sections being optically aligned with the transmit section of the waveguide respectively.

7. The microphone of claim 6, wherein the plurality of vibrating sections each have a different sensitivity to the acoustic energy so as to extend the dynamic range of the microphone.

8. The microphone of claim 6, wherein a first of the plurality of the vibrating sections has a first length and a first stiffness and a second of the plurality of the vibrating sections has a second length and a second stiffness, wherein the first length is shorter than the second length and the first stiffness is stiffer than the second stiffness so that the first of the plurality of vibrating sections has a lower sensitivity to the acoustic energy relative to the second of the plurality of vibrating sections.

9. The microphone of claim 1, wherein the light transmitter comprises either an LED or a Vertical Cavity Surface Emitting Laser (VCSEL).

10. The microphone of claim 1, wherein the receiver further comprises a photodiode that generates a capacitive charge that is in proportion to the amount of light received by the receive section of the waveguide.

11. A microphone, comprising:

a light transmitter configured to generate light;

a waveguide having optically aligned transmit, vibrating and receive sections, the waveguide configured to transmit the light from the light transmitter and through the transmit, vibrating and receive sections respectively, wherein the vibrating section is configured to vibrate in response to received acoustic energy so that the light received by the receive section is modulated in proportion to the acoustic energy; and a receiver to convert the modulated light received at the receive section of the waveguide to an electrical signal that is indicative of the received acoustic energy receiver wherein said receiver comprises a photodiode that generates a capacitive charge that is in proportion to the amount of light received by the receive section of the waveguide wherein the receiver further comprises a first switch that selectively couples the photodiode to a reference voltage to charge the photodiode to the reference voltage, the photodiode being configured to leak current to reduce the capacitive charge on the photodiode in an inverse proportion to the amount of light received by the receive section of the waveguide.

12. The microphone of claim 11, further comprising a charge-to-voltage converter to convert the capacitive charge generated by the photodiode into the electrical signal that is indicative of the received acoustic energy.

13. The microphone of claim 12, further comprising a second switch, coupled between the photodiode and the charge-to-voltage converter, the second switch controlling a sampling rate at which the capacitive charge of the photodiode is sampled by the charge-to-voltage converter.

14. The microphone of claim 12, wherein a sampling rate consists of one of the following: less than 8 Khz, approximately 8 Khz, between 8 to 16 Khz, between 16 Khz to 44 Khz, approximately 44 Khz, or more than 44 Khz.

15. The microphone of claim 6, further comprising a plurality of the receivers associated with the plurality of receive sections of the waveguide respectively.

16. A microphone, comprising:

a light transmitter configured to generate light;

a waveguide having optically aligned transmit, vibrating and receive sections, the waveguide configured to transmit the light from the light transmitter and through the transmit, vibrating and receive sections respectively, wherein the vibrating section is configured to vibrate in response to received acoustic energy so that the light received by the receive section is modulated in proportion to the acoustic energy;

wherein said vibrating and receive sections further comprise a plurality of vibrating sections and a plurality of receive sections, both the plurality of vibrating sections and the plurality of receive sections being optically aligned with the transmit section of the waveguide respectively, and a plurality of the receivers associated with the plurality of receive sections of the waveguide respectively to convert the modulated light received at the receive sections of the waveguides to an electrical signal that is indicative of the received acoustic energy; and a phase control circuit configured to control the phase of when the plurality of receivers sample the light received by the plurality of the vibrating sections and the plurality of the receive sections of the waveguide respectively.

17. The microphone of claim 6, wherein the plurality of vibrating sections and the plurality of receive sections form an array of microphones.

18. The microphone of claim 11, wherein the vibrating section is separated from the receive section by a portion of open space through which said optical path extends.

* * * * *